United States Patent [19]

Gold

[11] 4,018,340

[45] Apr. 19, 1977

[54] ADJUSTABLE DISPLAY UNIT

[76] Inventor: Joseph Gold, 202-456 W. Broadway, Vancouver, British Columbia, Canada, V5Y 1R3

[22] Filed: Nov. 10, 1975

[21] Appl. No.: 630,453

[30] Foreign Application Priority Data

Jan. 14, 1975 Canada ..... 217896

[52] U.S. Cl. ..... 211/44; 108/108; 211/184; 211/187; 248/175

[51] Int. Cl.² ..... A47F 7/18

[58] Field of Search ..... 211/37, 44, 57, 59, 211/71, 74, 13, 134, 148, 153, 176, 177, 181, 184; 248/346, 175, 153, 176; 108/106–111

[56] References Cited

UNITED STATES PATENTS

| | | | |
|---|---|---|---|
| 436,626 | 9/1890 | Dixon | 211/184 X |
| 1,280,445 | 10/1918 | Grace | 211/37 |
| 2,307,758 | 1/1943 | Brown | 211/44 |
| 2,933,195 | 4/1960 | Radek | 211/153 X |
| 3,096,008 | 7/1963 | Schumacher | 211/181 X |
| 3,159,437 | 12/1964 | Jentzen | 211/148 X |
| 3,272,345 | 9/1966 | Wallace | 211/44 |
| 3,297,374 | 1/1967 | Radek | 211/148 X |
| 3,669,278 | 6/1972 | Heroy | 211/184 |
| 3,677,202 | 7/1972 | Young | 108/109 |

FOREIGN PATENTS OR APPLICATIONS

| | | | |
|---|---|---|---|
| 634,836 | 3/1950 | United Kingdom | 211/44 |

*Primary Examiner*—Roy D. Frazier
*Assistant Examiner*—Terrell P. Lewis
*Attorney, Agent, or Firm*—Fetherstonhaugh & Company

[57] ABSTRACT

A display unit having a plurality of adjustably mounted shelves, and a plurality of holder units adjustably mounted on each shelf, each holder unit comprising a base and one or two elongated holders mounted on and projecting upwardly from each base, each holder being of such dimensions as to fit within a wound roll or fabric and being long enough to support the roll on end in a substantially vertical position.

10 Claims, 12 Drawing Figures

ADJUSTABLE DISPLAY UNIT

Figure 1:
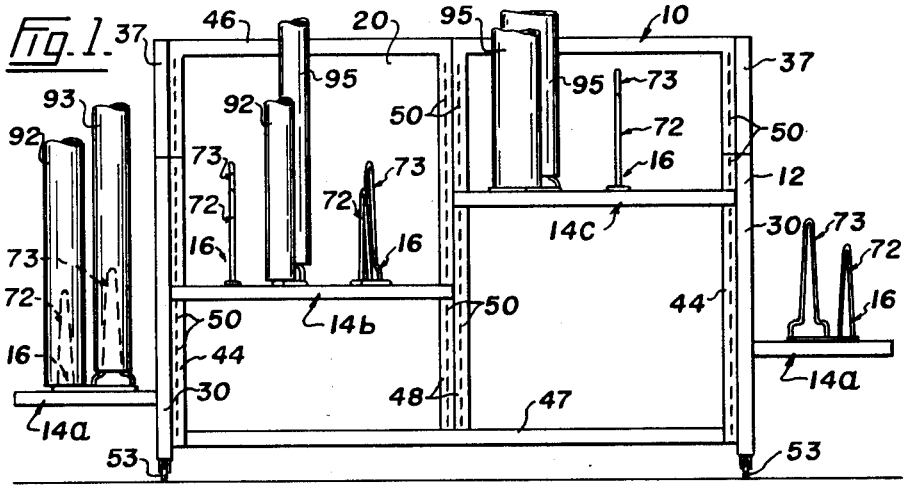

This invention relates to display units particularly for bolts or rolls of wound fabric.

Cloth fabrics are delivered to retail stores on tubes and sometimes are displayed on these tubes. Some of these tubes are so long that the fabric is removed therefrom, folded into half widths and then rolled onto boards to form what is commonly known as bolts. These bolts are often put on display in the store. The difficulty in the past has been to be able to display a large number of rolls (this term including bolts) in a limited amount of floor space and close enough together to display different combinations of material for coordinates. Stands have been made for the purpose, but they usually are rather large and heavy, and not adjustable to be able to allow for different arrangements of the rolls. In addition, each stand was constructed for a certain display arrangement, usually by a carpenter, and could not be changed for different types of displays.

The display units of the present invention can be made up in large numbers for sale. They are such that they are light, relatively small in comparison to the amount of material that can be displayed, and can be readily and easily adjusted for different display arrangements. Many different fabrics can be displayed simultaneously, making it convenient for customers and clerks, and making it possible to show off different combinations of material in close proximity to demonstrate different combinations for coordinates. A relatively large display of materials can be made in a small area, shelf combinations can be easily and quickly changed, and all parts are interchangeable. In addition, the unit is relatively inexpensive to construct.

A display unit according to the present invention comprises a support structure, a shelf mounted on said structure, and a plurality of holder units carried by the shelf, each holder unit comprising a base, and an elongated holder mounted on and projecting upwardly from the base, said holder being of such dimensions as to fit within a fabric roll and being long enough to support the roll on end in a substantially vertical position. It is to be understood that the term "roll" is used herein in a general sense, and includes bolts.

It is preferable to provide a plurality of shelves for the units, and these are staggered in the unit in relation to each other so as to be able to support fabric rolls on end in different positions relative to each other. The shelving is such that rolls can be located in front of other rolls without completely hiding the latter from view.

More specifically, a display unit according to this invention comprises a support structure, a plurality of shelves adjustably mounted on said structure, said shelves being staggered in relation to each other so as to be able to support fabric rolls on end, a plurality of holder units on each shelf, and securing means for locating each holder unit in any one of a plurality of positions on the shelf thereof and releasably securing said each unit to the shelf, each holder unit comprising a base, and an elongated holder mounted on and projecting upwardly from the base, said holder being of such dimensions as to fit within a fabric roll and being long enough to support the roll on end in a substantially vertical position.

Figure 2:
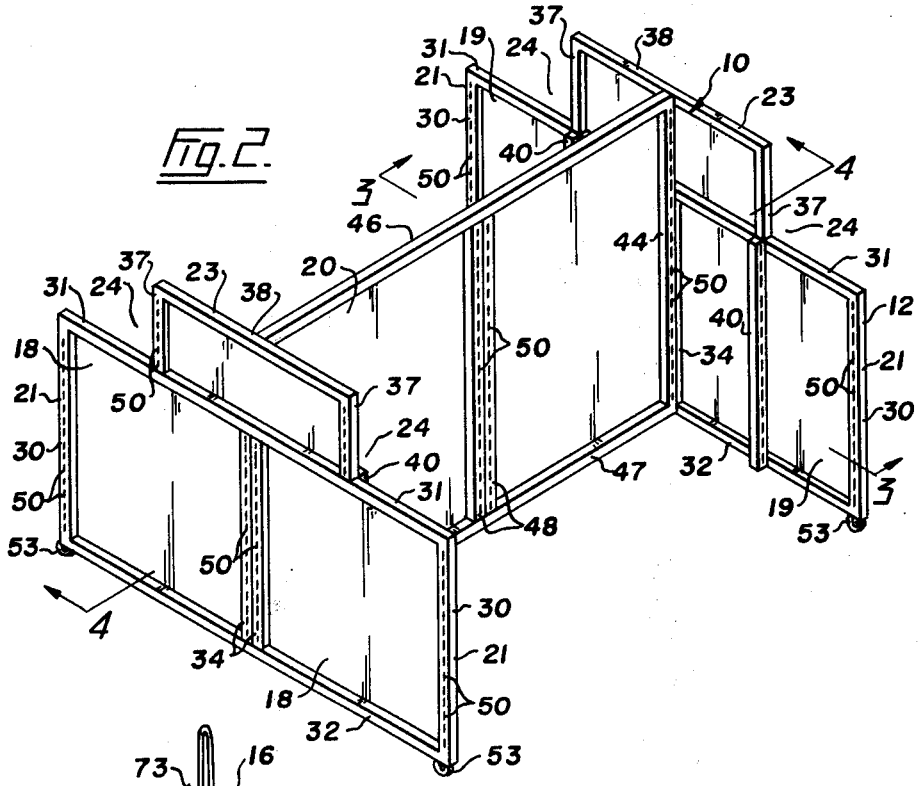
Figure 5:
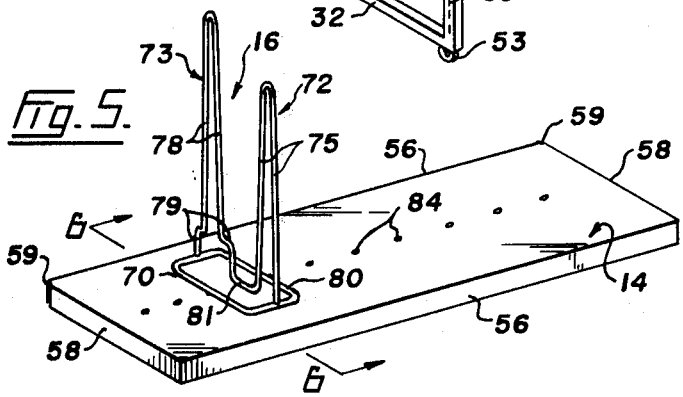
Figure 3:
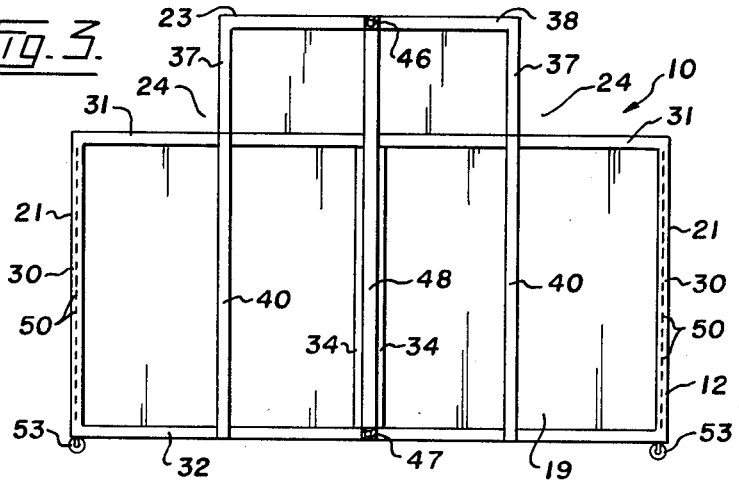
Figure 4:
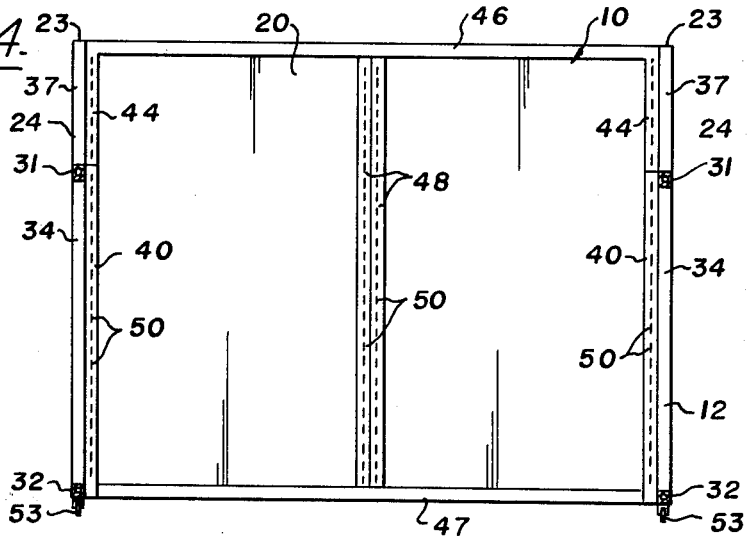
Figure 6:
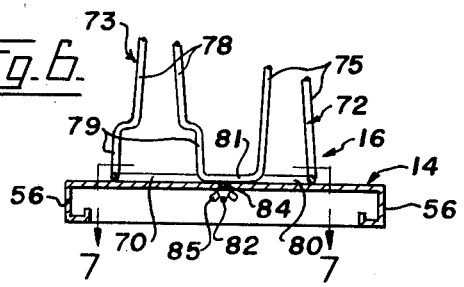
Figure 7:
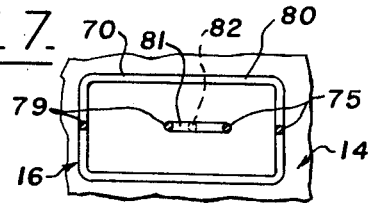
Figure 8:
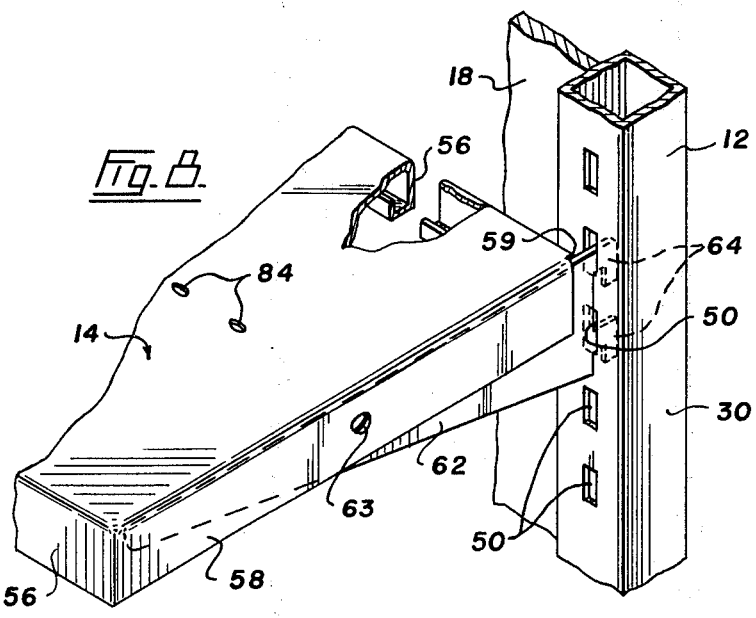

A preferred form of display unit is illustrated in the accompanying drawings, in which:

FIG. 1 is a front elevation of a display unit, illustrating one shelf arrangement by way of example, FIG. 2 is a perspective view of the support structure of the unit, with the shelves removed, FIG. 3 is a cross-section through the support structure taken on the line 3—3 of FIG. 2, FIG. 4 is a vertical longitudinal section taken on the line 4—4 of FIG. 2, FIG. 5 is an enlarged perspective view of a shelf with a holder unit mounted thereon, FIG. 6 is an enlarged vertical section taken on the line 6—6 of FIG. 5, FIG. 7 is a horizontal section taken on the line 7—7 of FIG. 6, FIG. 8 is an enlarged perspective view of a bracket supporting an end of a shelf, and FIGS. 9 to 12 diagrammatically illustrate different ways rows of fabrics can be displayed on a single holder unit.

Referring to the drawings, 10 is a display unit is accordance with this invention which includes a support structure 12, a plurality of shelves 14, and a plurality of holder units 16.

The support structure 12 may be formed in any desired manner and of any desired material, but it is preferably formed in an open framework by tubes of rectangular cross section for lightness of weight and for a minimum of obstruction to the view and display of fabrics thereon. In this example, structure 12 is formed by spaced-apart end walls 18 and 19 and a longitudinal vertical wall 20 extending between and connected to the end walls and spaced inwardly from outer edges 21 of said end walls. In this example, the end walls are not as high as the longitudinal wall and have central upwardly-extending sections which are as high as said longitudinal wall. This in effect forms large notches 24 at the upper corners of the end walls.

The outer edges of the end walls are formed by posts 30 interconnected by upper and lower bars 31 and 32. A pair of central posts 34 extend between bars 31 and 32 mid-way between side posts 30. The upper section 23 of each end wall is formed by two side posts 37 interconnected by an upper cross bar 38. Side posts 37 are secured to and project upwardly from upper bar 31 of the end wall. A vertical intermediate post 40 is mounted on each end wall between each of its side posts 30 and each of its central posts 34.

The longitudinal wall 20 is formed by end posts 44 mounted on the inner surfaces of end walls 18 and interconnected by upper and lower bars 46 and 47. The longitudinal wall may also have a pair of central posts 48 extending between its upper and lower bars 46 and 47.

By referring to FIG. 2, it will be seen that vertically aligned slots 50 are formed in the side posts 30, central posts 34, side posts 37 and intermediate posts 40 of each end wall 18. Similarly, vertically arranged slots 50 are formed in the end posts 44 and central posts 48 of longitudinal wall 20. If desired, the end walls 18 may be mounted on rollers or casters 53 in order that the display unit can be easily moved from plate to place.

Shelves 14 are adapted to be mounted in many different positions within support structure 12. The mounting can be accomplished in any desired manner, and one form of mounting is illustrated in FIG. 8. This shows an end of a shelf 14 mounted on a side post 30 of an end wall 18. In this example, shelf 14 has a downwardly extending flange 56 along each of its front and back edges, and another downwardly extending flange 58 on each end of the shelf. Each end of flange 56 at the back of the shelf terminates a little short of end flange 58 so that there is an opening 59 therebetween and beneath the upper surface of the shelf.

Mounting brackets 62 are provided for supporting the shelves 14. Each bracket 62 has a pair of vertically spaced hooks 64 projecting outwardly from one end thereof. These hooks are so spaced that they are adapted to fit into two vertically aligned slots 50 in side posts 30, at which time the bracket extends straight out from the post. Shelf 14 is moved down onto bracket 62 so that the bracket extends through the opening 59 at the back edge of the shelf and within end flange 58 so that in effect the shelf rests on the brackets and flange 58 prevents the shelf from falling off of them. If desired, a screw or bolt 63 may extend through each end flange 58 and the adjacent bracket firmly to secure the shelf in place. It will be seen that with a plurality of brackets 62 and a plurality of shelves 14, shelves can be mounted on support structure 12 in many different places and at different levels. FIG. 1 illustrates shelves 14A mounted on posts 30, 34 of the two end walls and projecting outwardly therefrom. A shelf 14B is mounted on posts 44 and 48 towards one end of the longitudinal wall 20 and a shelf 14C is mounted on posts 44, 48 towards the opposite end of said longitudinal wall. It is obvious that shelves can be mounted on the posts 37 of end wall extensions 33, and on posts 30, 40 of the end walls to project inwardly from the latter.

A plurality of holder units 16 are provided for mounting on the shelves 14. These holder units are clearly shown in FIGS. 5, 6 and 7. Each holder unit 16 comprises a base 70 having one or two holders mounted thereof and projecting outwardly therefrom. In this example there are two holders 72 and 73. Holder 72 is preferably in the form of a heavy wire bent into an elongated and inverted U having legs 75, the lower ends of which are secured to base 70. Holder 73 can be the same as holder 72 but it is preferably in the form of a heavy wire bent into an elongated and inverted U, and having legs 78 which are bent outwardly and downwardly adjacent their lower ends to form steps 79. The lower ends of these legs are secured to base 70. Although base 70 may be in the form of a plate, it is preferably formed of heavy wire bent into a hollow rectangle 80, in which case the outer legs 75 and 78 of the holder are secure to the rectangle 80, while the inner legs of these holders are joined by a horizontal connector 81 which in effect forms part of base 70.

Suitable means is provided for removably securing each holder unit 16 on a shelf. In the illustrated example, a bolt 82 is secured to and projects downwardly from connector 81 and through one of a plurality of holes 84 in the shelf, and has a wing nut 85 threaded on its lower end, see FIG. 6. When nut 85 is loose holder unit 16 can be swung into different positions on shelf 14 after which the nut is tightened to retain the unit in the adjusted position.

As stated above shelf 14 may be mounted in many different positions on support structure 12 for display purposes. In addition, one or more holder units 16 can be mounted on each shelf and these units can be swung and releasably secured into different angular positions relative to the shelf. In order to display rolls or bolts of fabric, these are placed endwise over the holders 72 and/or 73 to provide desired displays. A roll on a holder 73 rests on steps 79 thereof so that its upper end is raised above that of the roll on holder 72, thus providing a stepped arrangement.

FIGS. 9 to 12 diagrammatically illustrate different arrangements of fabric rolls on a holder unit 16.

Figure 9:
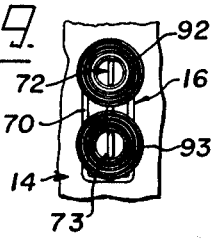

In FIG. 9, there are rolls 92 and 93 which are wound on circular cores in the usual manner placed endwise over holders 72 and 73. These holder hold the rolls in vertical alignment but unit 16 can be swung into different positions on its shelf 14.

Figure 10:
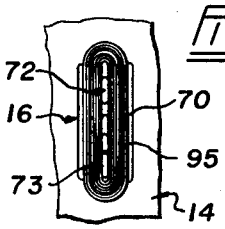

FIG. 10 illustrates a roll or bolt 95 of an elongated configuration in cross section placed endwise on aligned holders 72 and 73 of unit 16. This roll or bolt can be angularly adjusted by swinging holder unit 16 on the shelf.

Figure 11:
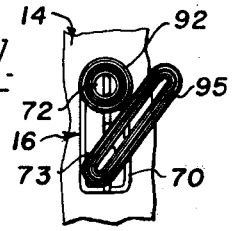

FIG. 11 illustrates a circular roll 92 on holder 72, and a bolt 95 on holder 73. In this case, one edge of the bolt is swung laterally relative to roll 92 so that it bears against the latter, the wire formation of holder 73 making this possible.

Figure 12:
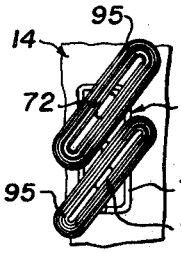

In FIG. 12, there are two bolts 95 respectively mounted on holder 72 and 73. These bolts, being elongated in cross section are swung at an angle to the holder base 70, the wire formation of the two holders making this possible.

From the above it will be seen that display unit 10 is very light and strong in construction and that a very large number of different display arrangements can be made by the number and positioning of the shelves and by the number, positioning and adjustment of the holder units. If it desired to change a display, it is only necessary to shift the brackets 62 of the required shelves into different positions on the various supporting posts of support structure 12. One or two rolls or both may be placed on each holder unit 16, and any number of these units may be used, and they may be quickly and easily adjusted to different positions relative to each other.

I claim:

1. A display unit for wound rolls of fabric, comprising a support structure, a shelf mounted on said structure, and a plurality of holder units carried by the shelf, each holder unit comprising a base, an elongated holder mounted on and projecting upwardly from the base, said holder being of such dimensions as to fit within a fabric roll and being long enough to support the roll on end in a substantially vertical position, a second holder mounted on the base of at least one holder unit, and a stop formed on said holder to support the lower end of a fabric roll thereon above the lower end of a roll on the adjacent holder.

2. A display unit as claimed in claim 1 in which each holder unit is removably mounted on the shelf thereof.

3. A display unit as claimed in claim 1 in which the base of each holder unit is mounted on the shelf thereof for horizontal swinging movement.

4. A display unit comprising a support structure, a plurality of shelves adjustably mounted on said structure, said shelves being staggered in relation to each other so as to be able to support fabric rolls on end, a plurality of holder units on each shelf, and securing means for locating each unit in any one of a plurality of positions on the shelf thereof and releasably securing said each unit to the shelf, each holder unit comprising a base, an elongated holder mounted on and projecting upwardly from the base, said holder being of such dimensions as to fit within a fabric roll and being long enough to support the roll on end in a substantially vertical position, a second holder mounted on the base of at least one of the holder units, and a stop formed on said second holder to support the lower end of a fabric roll thereon above the lower end of a roll on the adjacent holder.

5. A display unit as claimed in claim 4 in which each holder comprises a wire bent into an elongated and inverted U and having legs the lower ends of which are secured to the base of said each holder.

6. A display unit as claimed in claim 4 in which each holder comprises a wire bent into an elongated and inverted U and having legs the lower ends of which are secured to the base of said each holder, and the wire of each second holder is bent outwardly and downwardly to form the stop of said each second holder.

7. A display unit as claimed in claim 6 in which one leg of the second holder of each holder unit is elongated and projects downwardly through adjacent holes in the base of said unit and in the shelf in which the unit is located to form the securing means for said unit.

8. A display unit for wound rolls of fabric, comprising a holder unit to be mounted on a support, said holder unit comprising a base, an elongated holder mounted on and projecting upwardly from the base, said holder being of such dimensions as to fit within a fabric roll and being long enough to support the roll on end in a substantially vertical position, a second holder mounted on said base, and a stop formed on said second holder to support the lower end of a fabric roll thereon above the lower end of a roll on the adjacent holder.

9. A display unit as claimed in claim 8 in which each holder comprises a wire bent into an elongated and inverted U and having inner and outer legs, the lower ends of which are secured to said base, and the wire of the second holder is bent outwardly and downwardly to form the stop of said second holder.

10. A display unit as claimed in claim 9 in which said base comprises a wire bent into a hollow rectangle, the outer legs of the holders being secured at lower ends thereof to said rectangle base at opposite ends thereof, a connector joining lower ends of the inner legs of the holders, and connecting means secured to said connector and projecting downwardly therefrom to secure said holder unit to a support.

* * * * *